US005496093A

United States Patent [19]

Barlow

[11] Patent Number: 5,496,093

[45] Date of Patent: Mar. 5, 1996

[54] OPERATING A CONTINUOUS MINER

[75] Inventor: Desmond T. Barlow, Pretoria, South Africa

[73] Assignee: Csir & Sasol Mining Proprietary Ltd., Johannesburg, South Africa

[21] Appl. No.: 363,491

[22] Filed: Dec. 23, 1994

[51] Int. Cl.[6] ..... E21C 39/00; E21F 5/00

[52] U.S. Cl. ..... 299/1.1

[58] Field of Search ..... 299/1.1, 1.2, 30

[56] References Cited

U.S. PATENT DOCUMENTS

| | | | |
|---|---|---|---|
| 3,371,964 | 3/1968 | Weber | 299/1.1 |
| 3,961,307 | 6/1976 | Hochheimer et al. | 299/1.1 X |

FOREIGN PATENT DOCUMENTS

| | | | |
|---|---|---|---|
| 611022 | 6/1978 | U.S.S.R. | 299/1.2 |
| 740949 | 6/1980 | U.S.S.R. | 299/1.1 |
| 1086162 | 4/1984 | U.S.S.R. | 299/1.1 |
| 1452980 | 1/1989 | U.S.S.R. | 299/1.1 |

*Primary Examiner*—David J. Bagnell
*Attorney, Agent, or Firm*—Ladas & Parry

[57] ABSTRACT

A continuous miner has a pivotal boom mounting a rotor carrying picks for attaching and dislodging mineral deposit in a mineral deposit seam within host rock. A thin layer of mineral deposit is left respectively against a roof and against a floor. Ultrasonic sound waves are generated and are transmitted via a jet of water directed against the roof. Reflections are transmitted back via the jet of water to a receiver. Layers of the mineral deposit and the host rock are identified in respect of presence and location, by means of logic which generates a control signal to restrict pivoting of the boom to prevent cutting into the host rock by the rotor.

18 Claims, 1 Drawing Sheet

OPERATING A CONTINUOUS MINER

Figure 1:
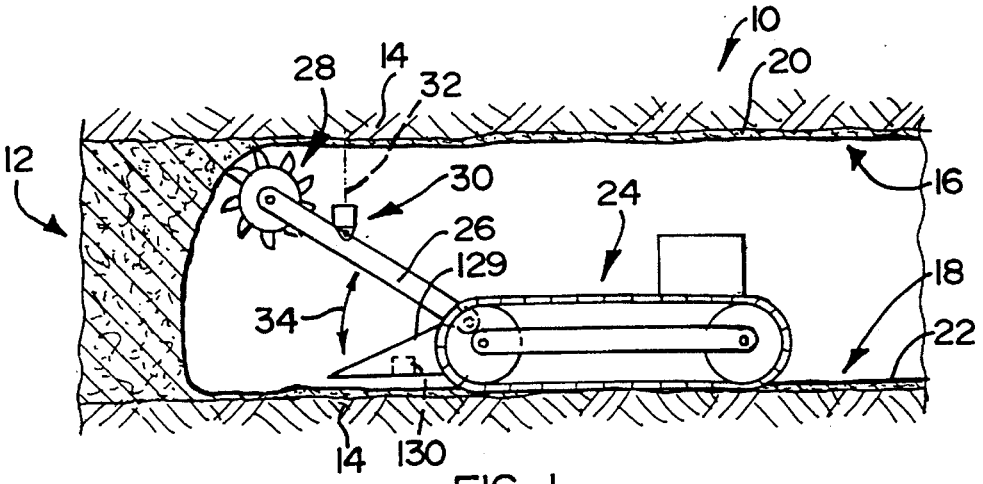

This Invention relates to mining. It relates more specifically to a method of operating a continuous miner, to control means suitable for use with a continuous miner, and to a continuous miner.

The Applicant believes that the invention is particularly advantageously applicable to coal mining. That application will predominantly be borne in mind for purposes of this specification. The invention is, however, not limited to coal mining.

A continuous miner of the kind to which this invention relates, is in the form of a vehicle, e.g. a track-driven vehicle, having a boom and a rotor mounted at an end of the boom. Picks mounted on the rotor dig into and dislodge coal from a working face when the rotor is rotated. The boom is pivoted about a lateral axis such that the boom sweeps, in an arc about a boom axis, through the coal seam.

It is important that extremities of the arc, corresponding respectively to the roof and the floor, are carefully selected. Ideally, as little coal as possible is left on the roof and on the floor without cutting into the roof and floor host rock. Cutting into the host rock reduces pick life and causes undesirable vibrations in the continuous miner. Under certain conditions, for example in the presence of dangerous concentrations of methane, sparks which are generated by cutting into the host rock may result in a safety hazard.

A secondary consideration is that a, so-called, lens of host rock can be present intermediate a major coal seam and a minor coal seam. It the lens is not mined out, there is a high risk, even probability, that it will collapse when unsupported, thus causing a safety hazard. Thus, from a safety consideration point of view, a lens should be mined out. There is also a financial consideration inasmuch as the minor coal seam can be mined if the lens is mined out. Thus, there is a financial trade-off in increasing the yield at the expense of reduced pick life and undesired vibrations. Thus, the relative and absolute thickness of the lens and the minor coal seam must be borne in mind.

In accordance with a first aspect of this invention, broadly, there is provided a method of mining a valuable mineral deposit present in the form of a seam within host rock by means of a continuous miner, the method including, in respect of at least one of a roof and a floor, repeatedly measuring the thickness of a relatively thin layer of valuable mineral deposit left against the host rock by means of ultrasonic sound waves, recording and extrapolating the measurements and comparing them with a predetermined thickness by means of logic, and generating a control signal by means of the logic to limit an extremity of a sweep of a rotor of the continuous miner to control the thickness of the layer of valuable mineral deposit left against the host rock.

Advantageously the method may be carried out in respect of both the roof and the floor.

Limiting the extremity of the sweep of the rotor is preferably automatic.

Preferably, the method may include transmitting a series of ultrasonic sound waves of different frequencies. The method may then include analyzing the reflected sound waves of said series of ultrasonic sound waves of different frequencies by means of neural networks to identify an interface between the seam of valuable mineral deposit and the host rock. The Applicant believes that the use of a series of different frequency sound waves analysed by means of neural networks will enhance the integrity of distinguishing mineral deposit layers from layers of other materials such as host rock.

Further in a preferred method, establishing contact between an ultrasonic sound wave generator/receiver and a mining face may be by means of a jet of fluid, conveniently water. The method may then include introducing the fluid (water) at regulated pressure into an ultrasonic sound wave transducer chamber, directing the fluid (water) in the form of a jet to impinge on the mining face, transmitting sound waves via the jet of fluid (water) to the mining face and receiving reflected sound waves via the jet of fluid (water).

By way of development, the method may include establishing via ultrasonic sound waves the existence of any lens and minor seam of valuable mineral deposit and the relative thickness of the lens and the minor seam. The method may include, by means of logic, comparing said thicknesses with predetermined data, making a decision on the basis of such comparison whether or not the lens should be mined out and the minor seam exploited, and generating a control signal accordingly.

The method may include adjusting a check in respect of the extremity of the arc through which the boom of the continuous miner is swept in response to the control signal.

In accordance with a second aspect, the invention extends to control means suitable for use in controlling a continuous miner to mine a valuable mineral deposit present in the form of a seam within host rock, the control means including

- a casing having mounting means for mounting it on a continuous miner to be in proximity of a cutting zone of a cutting rotor of the continuous miner;
- a transducer chamber in the casing;
- fluid jet generating means arranged in use to conduct a fluid through the transducer chamber and to direct the fluid in a fluid jet onto a mining face;
- an ultrasonic sound wave generator in the transducer chamber arranged to generate ultrasonic sound waves in the fluid jet in use;
- an ultrasonic sound wave receiver in the transducer chamber arranged to receive ultrasonic sound waves reflected in use via the fluid jet;
- transducing means for transducing the reflected sound waves into electric or electronic signals; and
- logic in communication with the transducing means and adapted to process the signals and to generate a control signal in response.

The casing may have mounting means for mounting it on or in a boom of the continuous miner behind the cutting rotor.

Preferably, the sound wave generator and receiver may be adapted, respectively, to generate and to receive sound waves in a series differing in frequency. The logic may preferably include neural networks for analyzing the reflections of the series of differing frequency sound waves to identify an interface between the seam of valuable mineral deposit and the host rock.

Conveniently, the fluid jet generating means may be water jet generating means.

In accordance with a third aspect, the invention extends to a continuous miner mounting control means as herein described, such that the control means is positioned proximate a cutting zone of a cutting head of the continuous miner.

Advantageously, the continuous miner may mount the control means such as to be in or on a boom behind the cutting rotor.

Advantageously, the continuous miner may mount a first control means as herein described such as to be associated with a roof, and a second control means as herein described such as to be associated with a floor. The second control means may be mounted on a component of the continuous miner positioned to be proximate a floor in use.

The continuous miner may have check means responsive to the control signal of the control means to check the boom at a desired extremity of an arc through which it is swept in use.

Figure 2:
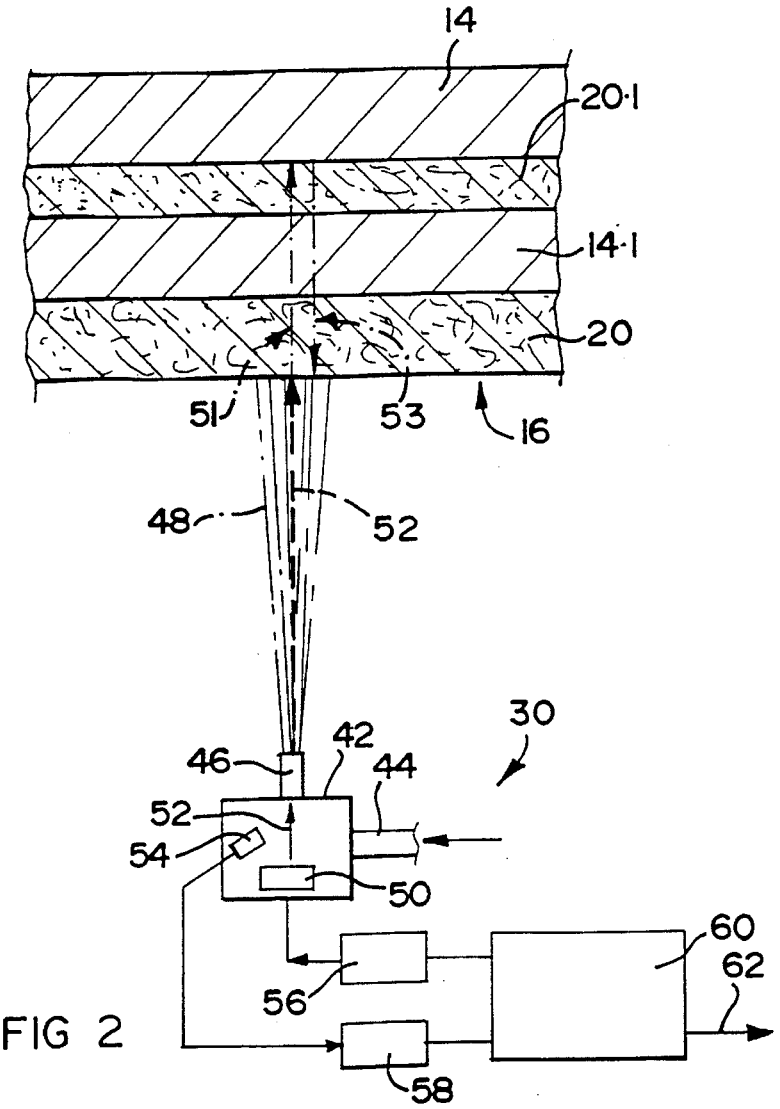

The invention is now described by way of example with reference to the accompanying diagrammatic drawings. In the drawings FIG. 1 shows a continuous miner in accordance with the invention in the process of mining a coal seam underground in a mine; and FIG. 2 shows, to a larger scale, schematically, operation of control means in accordance with the invention.

With reference to the drawings, reference numeral 10 generally indicates mining operations underground, and more specifically mining of a coal seam generally indicated by reference numeral 12 contained between layers of host rock generally indicated by reference numeral 14. The coal seam 12 is being mined out between a roof 16 and a floor 18. A thin layer of coal 20 is left against the roof 16. Correspondingly, a thin layer of coal 22 is left against the floor 18.

Mining is effected by means of a continuous miner generally indicated by reference numeral 24. It comprises a track-driven vehicle carrying a boom 26 mounting a rotor 28 at a free end thereof. The boom 26 is swept upwardly and downwardly in an arc as indicated by reference numeral 34 as the continuous miner 24 advances along the seam 12. Picks on the rotor dig into and dislodge coal.

In accordance with the invention, control means 30 is mounted on or in the boom 26 immediately behind the rotor 28. The control means 28 monitors the thickness of the layer 20 against the roof 16 and compares the measurements with earlier measurements to detect a trend and thus, by extrapolation, to predict the level of the face of the host rock 14 immediately ahead of the rotor 28.

Further, in accordance with the invention, a control signal is generated by means of which upward pivoting of the boom 26 is automatically checked to prevent the rotor 28 from cutting into the host rock 14.

Similarly, control means 130 is mounted on a component 129 fixed to a chassis or body of the continuous miner to be proximate to the floor in use to monitor the thickness of the layer of coal 22 on the floor 18 and to control downward pivoting of the boom 26 to prevent the rotor 28 from cutting into the host rock 14 underneath the floor 18.

As can be seen in FIG. 1, when the control means 30 monitors the layer 20 against the roof 16, a jet of water 32 is directed upwardly against the roof 16. Similarly, to monitor the thickness of the layer 22 against the floor 18, a jet of water will be ejected from the control means 130 against the floor 18.

With reference more specifically to FIG. 2, the control means 30 comprises a casing by means of which it is mounted in the boom 26. In the casing, there is defined a transducer chamber 42 having a water inlet 44 by means of which water is conducted into the chamber 42 under controlled pressure. A nozzle 46 is arranged to be generally perpendicularly upwardly directed as shown at 52 when the boom 26 is at its upper extremity. A water jet generally indicated by reference numeral 48 is directed at and impinges on the roof 16.

An ultrasonic sound wave transmitter 50 is provided within the transducer chamber 42 such as to be in physical contact with the water forming the water jet 48. Sound waves are generated by pulsing the transmitter from logic 60 via a converter 56 with a series of signals of differing frequencies, typically, about five different frequencies, falling in a wave band of, typically, between 40 kHz and 80 kHz. The series of acoustic pulses is transmitted along the water jet 48 to the roof 16 and thus impinge on the layer 20 and penetrate the layer 20 as well as layers beyond the layer 20 as indicated at 51. More specifically, as indicated at 53, reflected acoustic signals from the surface of the layer 20 and from the interface between the layer 20 and the host rock 14 are conducted back via the water jet 48 to be received by means of a receiver 54 located within the transducer 42 to be in contact with the water forming the water jet 48. An acoustic-to-electronic transducer 58 transduces the acoustic signals to electronic signals and feeds them into logic 60 where they are processed. The logic preferably makes use of neural networks. The logic calculates and compares the thickness of the layer 20 with earlier readings, establishes a pattern or trend, compares the pattern or trend with base data and generates a control signal as indicated by reference numeral 62 by means of which a check is introduced to check the boom 26 at a calculated upper extremity to ensure that the rotor 28 will not cut into the host rock 14.

As can be seen in FIG. 2, situations arise where a minor seam of coal generally indicated by reference numeral 20.1 is isolated from the major coal seam by means of a lens 14.1 of host rock. It has been established that, if the lens 14.1 remains after the coal seam 12 has been mined out, it is unsupported and has a great tendency to collapse thus creating a safety hazard.

Furthermore, economic considerations indicate that, if feasible, the minor seam 20.1 should be utilized to increase the yield. However, cutting into the lens 14.1 reduces the life of the picks on the rotor 28 and also causes undesired vibrations in the continuous miner 24.

In accordance with the invention, the thickness of the lens 14.1 and the minor seam 20.1 are also measured ultrasonically which information is also processed by means of the logic 60. Such information is compared to predetermined data and on the basis of the comparison, a decision is made whether or not to mine out the lens 14.1 and the minor seam 20.1. If such mining out is to take place, the control signal 62 is generated accordingly to allow the boom 26 to sweep further upwardly to mine out the lens 14.1 and the minor seam 20.1 leaving a relatively thin layer of coal.

FIG. 2 illustrates the situation at the roof 16. The system is generally duplicated in respect of the floor 18. Simplification may be possible bearing in mind that the system 130 is fixed relative to the chassis or body of the continuous miner.

It is an advantage that ultrasonic sound waves are used to measure the respective thicknesses of layers at the roof and at the floor of mining operations as described above and that the sound waves can be generated and reflections received by means of apparatus spaced from the work face. As mentioned above, the Applicant has found by way of routine experimentation that the integrity of recognising the various layers is improved if a series of sound waves of different frequencies is employed and if the reflections are analyses by means of neural networks. The criteria of thus recognising the layers change from application to application. Routine experimentation may be required for different applications.

It is further an advantage that the sweeping arc of the boom 26 can be adjusted to ensure that a thin layer of coal is left against the roof and against the floor to prevent the rotor from penetrating the host rock.

It is yet further an advantage that, on the basis of measurements taken ultrasonically, the presence of a lens and of a minor coal seam can be established and that decisions can be made based on such measurements whether or not it is feasible to mine out the lens and the minor seam.

It is important that measurements are taken immediately behind the rotor 28 thus allowing the extrapolated information to be of relatively high integrity.

I claim:

1. A method of mining a valuable mineral deposit present in the form of a seam within host rock by means of a continuous miner, the method including, in respect of at least one of a roof and a floor, repeatedly measuring the thickness of a relatively thin layer of valuable mineral deposit left against the host rock by means of ultrasonic sound waves, including establishing contact between an ultrasonic sound-wave generator/receiver and a mining face by means of a jet of fluid, recording and extrapolating the measurements and comparing them with a predetermined thickness by means of logic, and generating a control signal by means of the logic to limit an extremity of a sweep of a rotor of the continuous miner to control the thickness of the layer of valuable mineral deposit left against the host rock.

2. A method as claimed in claim 1 which is carried out in respect of both the roof and the floor.

3. A method as claimed in claim 1 in which limiting the extremity of the sweep of the rotor is automatic.

4. A method as claimed in claim 1 which includes transmitting a series of ultrasonic sound waves of different frequencies.

5. A method as claimed in claim 4 which includes analysing the reflected sound waves of said series of ultrasonic sound waves of different frequencies by means of neural networks to identify an interface between the seam of valuable mineral deposit and the host rock.

6. A method as claimed in claim 1 which includes introducing the fluid at regulated pressure into an ultrasonic sound wave transducer chamber, directing the fluid in the form of a jet to impinge on the mining face, transmitting sound waves via the jet of fluid to the mining face and receiving reflected sound waves via the jet of fluid.

7. A method as claimed in claim 1 including establishing via ultrasonic sound waves the existence of any lens and minor seam of valuable mineral deposit and the relative thickness of the lens and the minor seam.

8. A method as claimed in claim 7, including, by means of logic, comparing said thicknesses with predetermined data, making a decision on the basis of such comparison whether or not the lens should be mined out and the minor seam exploited, and generating a control signal accordingly.

9. A method as claimed in claim 8 including adjusting a check in respect of the extremity of the arc through which the boom of the continuous miner is swept in response to the control signal.

10. Control means suitable for use in controlling a continuous miner to mine a valuable mineral deposit present in the form of a seam within host rock, the control means including a casing having mounting means for mounting it on a continuous miner to be in proximity of a cutting zone of a cutting rotor of the continuous miner;

a transducer chamber in the casing;

fluid jet generating means arranged in use to conduct a fluid through the transducer chamber and to direct the fluid in a fluid jet onto a mining face;

an ultrasonic sound wave generator in the transducer chamber arranged to generate ultrasonic sound waves in the fluid jet in use;

an ultrasonic sound wave receiver in the transducer chamber arranged to receive ultrasonic sound waves reflected in use via the fluid jet;

transducing means for transducing the reflected sound waves into electric or electronic signals; and logic in communication with the transducing means and adapted to process the signals and to generate a control signal in response.

11. Control means as claimed in claim 10 in which the casing has mounting means for mounting it on or in a boom of the continuous miner behind the cutting rotor.

12. Control means as claimed in claim 10 in which the sound wave generator and receiver are adapted, respectively, to generate and to receive sound waves in a series differing in frequency.

13. Control means as claimed in claim 12 in which the logic includes neural networks for analysing the reflections of the series of differing frequency sound waves to identify an interface between the seam of valuable mineral deposit and the host rock.

14. Control means as claimed in claim 10 in which the fluid jet generating means is water jet generating means.

15. A continuous miner including control means mounted thereon such as to be proximate a cutting zone of a cutting rotor of the continuous miner the control means being suitable for use in controlling the continuous miner to mine a valuable mineral deposit present in the form of a seam within host rock, the control means including a casing having mounting means mounting it on the continuous miner;

a transducer chamber in the casing;

fluid jet generating means arranged in use to conduct a fluid through the transducer chamber and to direct the fluid in a fluid jet onto a mining face;

an ultrasonic sound wave generator in the transducer chamber arranged to generate ultrasonic sound waves in the fluid jet in use;

an ultrasonic sound wave receiver in the transducer chamber arranged to receive ultrasonic sound waves reflected in use via the fluid jet;

transducing means for transducing the reflected sound waves into electric or electronic signals; and logic in communication with the transducing means and adapted to process the signals and to generate a control signal in response.

16. A continuous miner as claimed in claim 15 in which the control means is mounted in or on a boom behind the cutting rotor.

17. A continuous miner as claimed in claim 15, in which said control means is first control means which is mounted such as to be associated with a roof, the continuous miner further comprising a second control means which is similar to said first control means, said second control means being mounted such as to be associated with a floor.

18. A continuous miner as claimed in claim 17 which has check means responsive to the control signal of the control means to check the boom at a desired extremity of an arc through which it is swept in use.

* * * * *